US010989439B2

(12) United States Patent
Sekar et al.

(10) Patent No.: US 10,989,439 B2
(45) Date of Patent: Apr. 27, 2021

(54) DAMPER ASSEMBLY

(71) Applicant: Air Distribution Technologies IP, LLC, Milwaukee, WI (US)

(72) Inventors: Ashwath Sekar, Chennai (IN); A K S Manian, Pune (IN); Parmeshwar G. Patil, Pune (IN); Vikas A. Patil, Pune (IN); Rajarajan Balaraman, Pune (IN)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 197 days.

(21) Appl. No.: 16/032,922

(22) Filed: Jul. 11, 2018

(65) Prior Publication Data

US 2019/0017724 A1 Jan. 17, 2019

Related U.S. Application Data

(60) Provisional application No. 62/532,316, filed on Jul. 13, 2017.

(51) Int. Cl.
*F24F 13/14* (2006.01)
*F24F 11/76* (2018.01)

(52) U.S. Cl.
CPC ..... *F24F 13/1413* (2013.01); *F24F 11/76* (2018.01); *F24F 13/1426* (2013.01)

(58) Field of Classification Search
CPC ..... F24F 13/1413; F24F 11/76; F24F 13/1426
See application file for complete search history.

(56) References Cited

U.S. PATENT DOCUMENTS

| | | | | |
|---|---|---|---|---|
| 3,847,210 | A | 11/1974 | Wells | |
| 4,449,664 | A * | 5/1984 | Mithuhira | G05D 23/1906 236/49.3 |
| 4,694,851 | A | 9/1987 | Aalto et al. | |
| 6,049,299 | A | 4/2000 | Lunacek et al. | |
| 6,698,219 | B2 | 3/2004 | Sekhar et al. | |
| 2010/0178863 | A1 | 7/2010 | Coward | |
| 2016/0313018 | A1 | 10/2016 | Leeland et al. | |
| 2016/0341439 | A1 * | 11/2016 | Karamanos | G05D 7/0635 |

FOREIGN PATENT DOCUMENTS

| | | | |
|---|---|---|---|
| EP | 0924475 | A1 | 6/1999 |
| WO | 2008035103 | A1 | 3/2008 |
| WO | 2017054055 | A1 | 4/2017 |

* cited by examiner

*Primary Examiner* — Jessica Yuen
(74) *Attorney, Agent, or Firm* — Fletcher Yoder, P.C.

(57) ABSTRACT

A damper to manage air flow includes a housing that defines a passageway through which the air flow is directed. The damper includes a ring having a flat surface that terminates at an outside dimension and at an inside dimension, where the outside dimension is disposed to fit within the passageway and is pivotably rotatable along an axis that bisects the passageway. The damper also includes a disc having a flat surface that terminates at an outside dimension that is nested within the inside dimension of the ring in a gimballed relationship and is pivotably rotatable along the axis. The damper further includes an actuator coupled to the ring and the disc, where the actuator is configured to separately rotate each of the ring and the disc about the axis.

21 Claims, 7 Drawing Sheets

DAMPER ASSEMBLY

CROSS REFERENCE TO RELATED APPLICATIONS

This application claims priority from and the benefit of U.S. Provisional Application Ser. No. 62/532,316, entitled "ENERGY EFFICIENT VARIABLE AIR VOLUME (VAV) UNIT," filed Jul. 13, 2017, which is hereby incorporated by reference in its entirety for all purposes.

BACKGROUND

This disclosure relates generally to heating, ventilation, and air conditioning (HVAC) systems. Specifically, the present disclosure relates to a damper for HVAC units.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

A heating, ventilation, and air conditioning (HVAC) system may be used to thermally regulate an environment, such as a building, home, or other structure. The HVAC system generally includes a vapor compression system having heat exchangers, such as a condenser and an evaporator, and a compressor that is configured to circulate a refrigerant there between. A system of ductwork is typically used to direct a flow of air across the heat exchangers, and thus, enable the heat exchangers to transfer thermal energy between the structure and an external environment. In many cases, a damper and a fan are fluidly coupled to the ductwork, which cooperate to modulate a flow rate of the air within the ductwork. Unfortunately, conventional dampers may significantly restrict a flow path of the airflow, which generates a relatively large pressure differential across the damper. As such, conventional dampers may significantly increase or decrease a static pressure within certain sections of the ductwork which, in some cases, reduces an operational energy efficiency of the fan and the HVAC system.

SUMMARY

The present disclosure relates to a damper to manage air flow, where the damper includes a housing that defines a passageway through which the air flow is directed. The damper includes a ring having a flat surface that terminates at an outside dimension and at an inside dimension, where the outside dimension is disposed to fit within the passageway and is pivotably rotatable along an axis that bisects the passageway. The damper also includes a disc having a flat surface that terminates at an outside dimension that is nested within the inside dimension of the ring in a gimballed relationship and is pivotably rotatable along the axis. The damper further includes an actuator coupled to the ring and the disc, where the actuator is configured to separately rotate each of the ring and the disc about the axis.

The present disclosure also relates to a damper to manage air flow, where the damper includes a housing that defines a passageway through which air is directed and an inner blade having a flat surface that terminates in at an outside dimension. The damper includes an outer blade having a flat surface that terminates in at an outside dimension and at an inside dimension, where the outer blade and the inner blade are in a concentric arrangement and rotatable about an axis. The outside dimension of the inner blade fits within the inside dimension of the outer blade, and the outside dimension of the outer blade fits within the passageway. The damper also includes an actuator coupled to the inner blade and the outer blade that is configured to separately adjust each of the inner blade and the outer blade between a respective open position and a respective closed position relative to the passageway. The damper further includes a controller that is configured to receive feedback indicative of an operational parameter and control the actuator to adjust respective positions of the first blade and the second blade based on the feedback.

The present disclosure also relates to a damper to control air flow, where the damper includes a housing that defines a passageway having a cross-sectional area through which air is directed and a first blade having a flat surface that opens and closes within the passageway. The first blade bisects the passageway when in the closed position such that the flat surface of the first blade is in opposition to the air flow and the flat surface of the first blade has an area that is less than the cross-sectional area of the passageway. The damper also includes a second blade having a flat surface that opens and closes within the passageway, where the second blade bisects the passageway when in the closed position such that the flat surface of the second blade is in opposition to the air flow and the flat surface of the second blade has an area that is less than the area of the passageway. The area of the flat surface of the first blade when added to the area of the flat surface of the second blade is equal or less than the cross-sectional area of the passageway. The damper also includes a controller that is connected to an actuator, wherein the actuator is configured to separately open and close the first blade and the second blade.

BRIEF DESCRIPTION OF THE DRAWINGS

Various aspects of this disclosure may be better understood upon reading the following detailed description and upon reference to the drawings in which.

DETAILED DESCRIPTION

Figure 1:
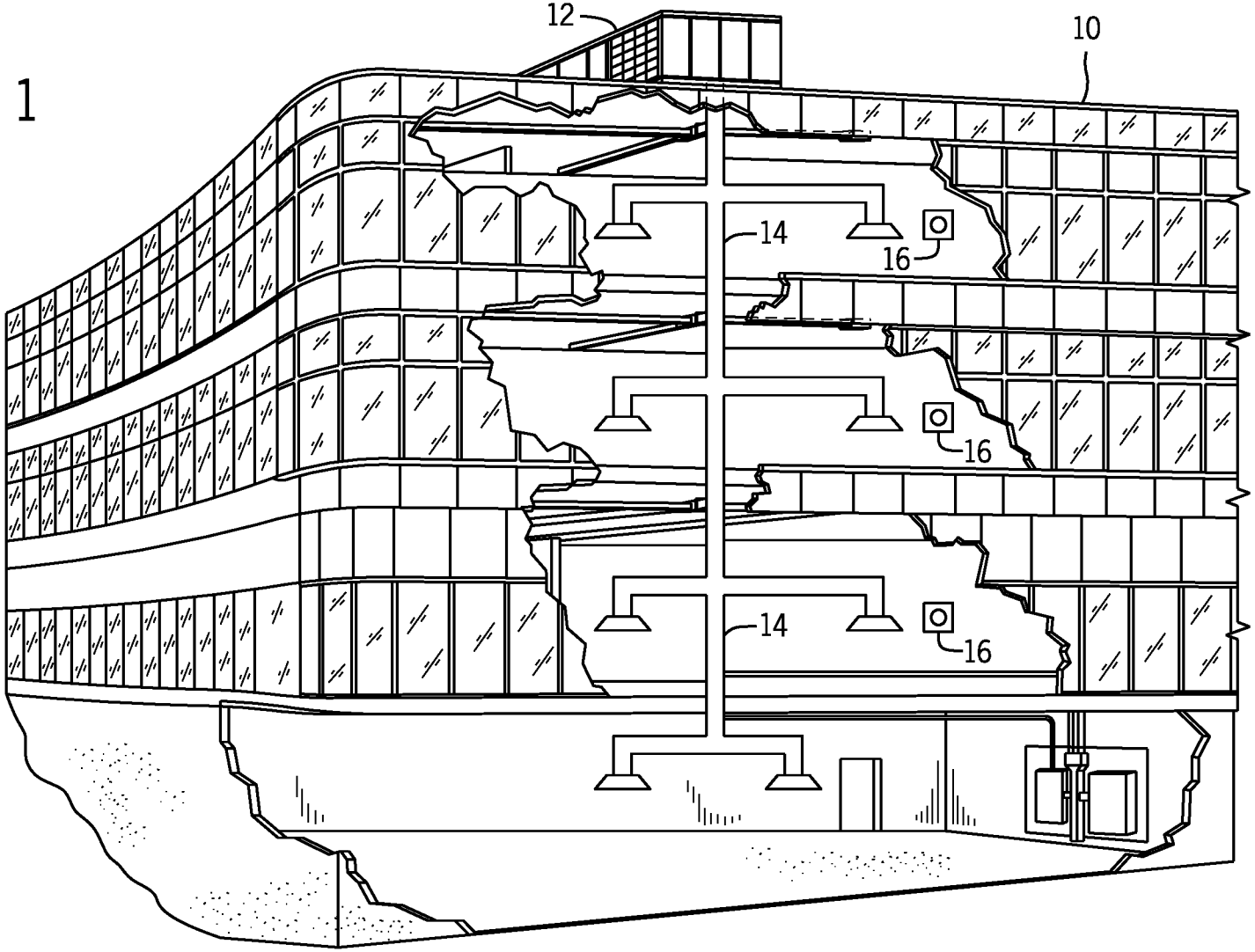
FIG. 1 is a perspective view of an embodiment of a building that may utilize a heating, ventilation, and air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As mentioned above, a heating, ventilation, and air conditioning (HVAC) system may include ductwork, or a system of ductwork, which defines a flow path of air extending between various components of the HVAC system, such as a condenser and an evaporator, and a conditioned space. Refrigerant within the condenser and the evaporator may exchange thermal energy with the air, and thus, condition the flow of air. In certain cases, a fan may be disposed within and configured to facilitate the ingress or egress of air throughout the ductwork. The HVAC system may also include dampers within the ductwork, which may be used to modulate a flow rate of the air by adjusting an effective cross-sectional area of the flow path. For example, conventional dampers typically include a damper housing with a single damper blade disposed therein. The damper blade is configured to transition between a fully open position and a fully closed position and, as such, modulate an effective cross-sectional area of the flow path. Accordingly, increasing or decreasing the effective cross-sectional area of the flow path increases or decreases, respectively, a flow rate of air traversing the damper. Unfortunately, typical damper blades have a relatively small stroke angle which, in some cases, significantly restricts the flow path of the air between the damper blade and the damper housing. As a result, conventional dampers generate significant static pressure deviations between an upstream end portion and a downstream end portion of the damper. In many cases, an operational speed of the fan is increased to negate such pressure deviations within the ductwork, such that the fan may continue to direct air along the flow path.

It is presently recognized that increasing the fan speed likewise increases a power consumption of the fan, and thus, decreases an operational efficiency of the HVAC system. As such, it is recognized that it is desirable to mitigate pressure differentials across the damper. Furthermore, fluidic restrictions generated due to the small stroke angle of conventional dampers facilitates the development of turbulent airflow downstream of the damper. This may generate undesirable audible noise while air flows through the damper, which may be unpleasant for occupants of a residence or commercial structure where the HVAC system is located. Accordingly, it is presently recognized that improved air flow modulation across dampers and within ductwork is desired.

With the foregoing in mind, embodiments of the present disclosure are directed to a flow modulation device, referred to herein as a split-blade damper, which modulates a flow rate of air through the ductwork while simultaneously reducing a pressure differential between an upstream end portion and a downstream end portion of the flow modulation device. For example, the flow modulation device includes a housing having a fixed cross-sectional area that is coupled to the ductwork, such that the flow path of the air extends through the housing. As described in greater detail herein, a damper assembly is disposed within the housing and is configured to modulate an effective cross-sectional area of the flow path or, in other words, a percentage of the total cross-sectional area of the housing through which the air may flow. In particular, the damper assembly includes a pair of concentric damper blades, such as an inner blade and an outer blade, which are each coupled to a respective shaft of a pair of concentric shafts. The concentric shafts enable the inner blade and the outer blade to individually rotate between a respective fully closed position and a respective fully open position. When the damper blades are in the fully closed position, the effective cross-sectional area of the flow path is substantially zero, such that the damper assembly blocks substantially all airflow through the flow modulation device. Conversely, the effective cross-sectional area of the flow path is substantially equal to the fixed cross-sectional area of the housing when the damper blades are disposed in the fully open position, and thus, enables a threshold flow rate of air to flow through the flow modulation device.

In some embodiments, a cross-sectional area of the inner blade may be approximately half of the total cross-sectional area of the damper assembly. As such, a stroke angle of the inner blade may be amplified during operation of the flow modulation device. For example, a relatively large stroke angle of the inner blade generates an effective cross-sectional area of the flow path that is substantially equal to an effective cross-sectional area of the flow path generated by rotating a single conventional damper blade by a relatively small stroke angle. As described in greater detail herein, the increased stroke angle of the inner blade increases a width of the flow path between the inner and outer damper blades, and thus, reduces friction forces generated by excessive restriction of the airflow. As such, a pressure differential between the upstream and downstream end portions of the flow modulation device may be reduced. Increasing the flow path width also reduces turbulent flow that may be generated when the air flows through the flow modulation device, and thus, reduces or substantially eliminates audible noise that is generated during modulation of airflow through the flow modulation device. As described in greater detail herein, the damper assembly may modulate airflow through the flow modulation device using only the inner blade, which is configured to move between a respective fully open position and a respective fully closed position, when a desired flow rate of the air is within a first threshold range. In such cases, the outer blade may remain in the fully closed position. Conversely, the flow modulation device may modulate the flow rate of the air using the outer damper blade when the desired flow rate is within a second threshold range that is above the first threshold range. In such cases, the inner blade is disposed in the fully open position, while the outer blade is adjusted between a respective fully open position and a respective fully closed position.

A driving unit is rotatably coupled to each of the inner and outer damper blades, such that the driving unit can adjust a position of each of the damper blades individually. In some cases, the driving unit may be communicatively coupled to a controller of the flow modulation device, which can instruct the driving unit to modulate the position of the damper blades based off feedback received from sensors disposed within the housing of the flow modulation device and/or any suitable portions the HVAC system, such as the ductwork. Accordingly, the controller may modulate an effective cross-sectional area of the flow path extending through the flow modulation device by moving the inner blade and/or the outer blade between the respective fully open and fully closed positions, and thus, maintain a flow rate of the air through the flow modulation device that is substantially equal to a desired target flow rate. These and other features will be described below with reference to the drawings.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

It should be appreciated that any of the features described herein may be incorporated with the HVAC unit 12, a residential heating and cooling system, or any other suitable HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 2:
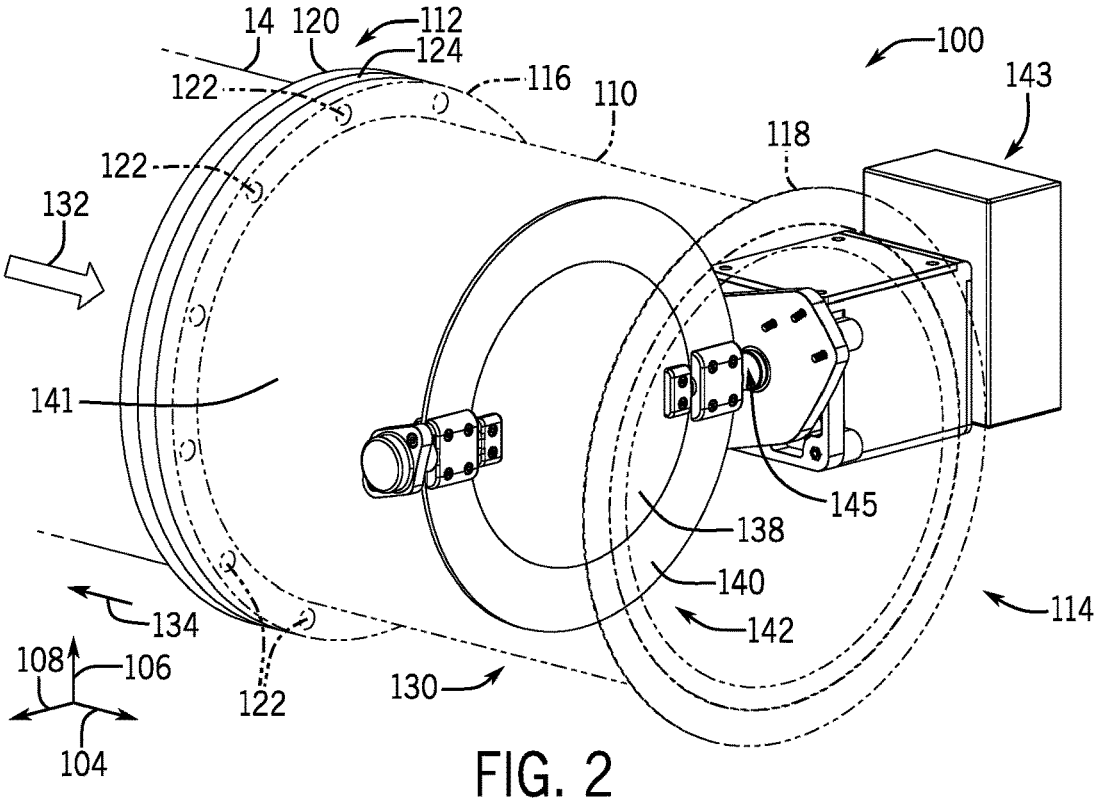
FIG. 2 is a perspective view of an embodiment of a flow modulation device that may be used in the HVAC system of FIG. 1, in accordance with an aspect of the present disclosure.

With the foregoing in mind, FIG. 2 is a perspective view of an embodiment of a flow modulation device, referred to herein as a split-blade damper 100, or a damper, which may be coupled to the ductwork 14 of the HVAC unit 12, ductwork of a residential heating and cooling system, or any other suitable ductwork and/or conduit. To facilitate discussion, the split-blade damper 100 and its components will be described with reference to a longitudinal axis or direction 104, a vertical axis or direction 106, and a lateral axis or direction 108. The split-blade damper 100 includes a housing 110 that extends along the longitudinal direction 104 from an upstream end portion 112 of the split-blade damper 100 to a downstream end portion 114 of the split-blade damper 100. In some embodiments, a cross-sectional shape of the housing 110 may be generally circular. However, in other embodiments, the housing 110 may include any other suitable cross-sectional shape, such as square, rectangular, etc. Further, the housing 110 may be constructed of sheet metal, aluminum, fiberglass, or any other suitable material that may be contoured to the cross-sectional shape of the housing 110.

The housing 110 includes a first flange 116 and a second flange 118 that are disposed near the upstream end portion 112 and the downstream end portion 114 of the split-blade damper 100, respectively, and facilitate coupling the split-blade damper 100 to the ductwork 14. For example, the ductwork 14 may include a mating flange 120 having a cross-sectional shape that is substantially similar to a cross-sectional shape of the first flange 116. Thus, the mating flange 120 may engage with the first flange 116 to couple the housing 110 to the ductwork 14. In some embodiments, fasteners 122, such as bolts, clamps, adhesives, or the like, may couple the mating flange 120 to the first flange 116. In some embodiments, a gasket 124 may be disposed between the mating flange 120 and the first flange 116, such that the gasket 124 forms a fluidic seal between the mating flange 120 and the first flange 116. As a non-limiting example, the gasket 124 may include cork, rubber, silicone, foam, or any other suitable gasket or sealing material. Similar to the first flange 116, the second flange 118 also couples to a respective mating flange of the ductwork 14 that is disposed near the downstream end portion 114 of the split-blade damper 100.

It should be noted that, in certain embodiments, a cross-sectional shape of the housing 110 may be different than a cross-sectional shape of the ductwork 14. For example, the housing 110 may include a generally circular cross-sectional shape while the ductwork 14 includes a generally rectangular cross-sectional shape 14. In such embodiments, an adapter is disposed between the first and second flanges 116, 118 and the mating flange(s) 120 of the ductwork 14. For example, a first end portion of the adapter can include a first cross-sectional shape that is substantially similar to the cross-sectional shape of the split-blade damper 100, while a second end portion of the adapter includes a second cross-sectional shape that is substantially similar to the cross-sectional shape of the ductwork 14. As such, the adapter can be disposed between the ductwork 14 and the split-blade damper 100, and thus, enable the enable the split-blade damper 100 to couple to the ductwork 14 in cases when, for example, a size, a cross-sectional shape, or an orientation of the ductwork 14 is different than that of the split-blade damper 100. As such, the split-blade damper 100 can be coupled to new or preexisting ductwork 14 having various configurations. It should be noted that in certain embodiments, the adapter may be integrated with the housing 110 of the split-blade damper 100. In other words, a cross-sectional shape of the first flange 116 and/or a cross-sectional shape the second flange 118 may be configured to match a cross-sectional shape of the mating flange(s) 120 of the ductwork 14. In such cases, the cross-sectional shape of the first and second flanges 116, 118 may be substantially similar or different from one another.

As described in greater detail herein, the split-blade damper 100 includes a damper assembly 130 that is disposed within the housing 110 and configured to modulate a flow rate of fluid, such as air, which may flow through the housing 110. The air may flow along the axis 104, or, in other words, in a downstream direction 132 from the upstream end portion 112 of the split-blade damper 100 to the downstream end portion 114 of the split-blade damper 100. However, it should be noted that in other embodiments, the air may flow in an upstream direction 134 from the downstream end portion 114 toward the upstream end portion 112 of the split-blade damper 100.

Figure 9:
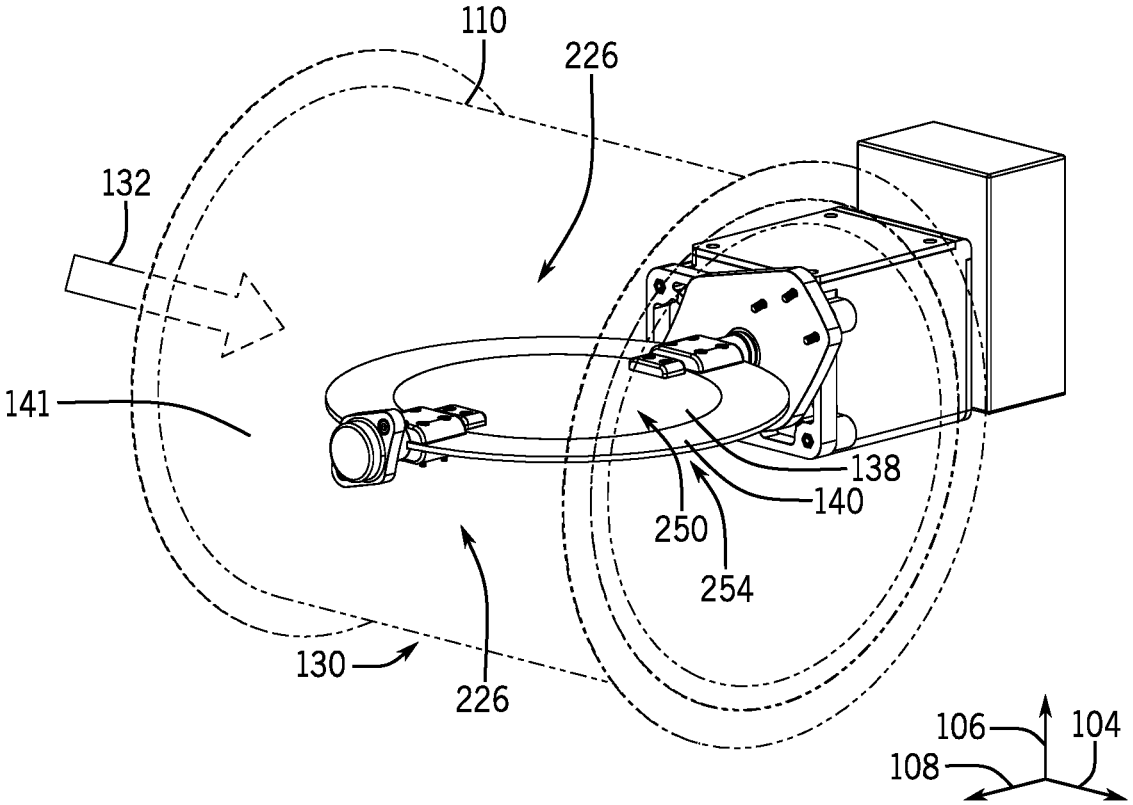
FIG. 9 is a perspective view of an embodiment of the flow modulation device of FIG. 2, in accordance with an aspect of the present disclosure.

The damper assembly 130 includes an inner blade 138 having a flat surface, such as a disc or a second blade, and an outer blade 140 having a flat surface, such as a ring or a first blade, that are disposed concentric to one another within the housing 110. In other words, the inner blade 138 is disposed within an aperture of the outer blade 140, such that the inner blade 138 and the outer blade 140 are in a gimballed relationship. As described in greater detail herein, the inner and outer blades 138, 140 are each configured to rotate about the lateral axis 108, and thus, modulate an effective cross-sectional area of a flow path 141 extending through the housing 110 of the split-blade damper 100. For example, when the inner and outer blades 138, 140 are disposed in respective fully open positions, as shown in FIG. 9, a cross-sectional area of the flow path 141 is substantially equal to a cross-sectional area of the housing 110. As such, the air may flow through the flow path 141 substantially unrestricted. The inner blade 138 and the outer blade 140 of the damper assembly 130 may each transition, or rotate, to any position between the respective fully open position and, for example, a respective fully closed position 142, as shown in FIG. 2. The effective cross-sectional area of the flow path 141 is substantially zero when the inner and outer blades 138, 140 are disposed in the respective fully closed position 142, and thus, the inner and outer blades 138, 140 block substantially all airflow across the split-blade damper 100. The inner and outer blades 138, 140 can modulate a flow rate of the air 132 by adjusting a percentage of the total cross-sectional area of the housing 110 through which the air 132 may flow. As described in greater detail herein, rotation of the damper assembly 130 may be provided by a driving assembly or unit 143 that is rotatably coupled to a shaft 145 extending from each of the inner and outer blades 138, 140. Accordingly, the driving assembly 143 may move each of the blades 138, 140 within the damper assembly 130 to the fully closed position 142, the fully open position, or any position there between.

Figure 3:
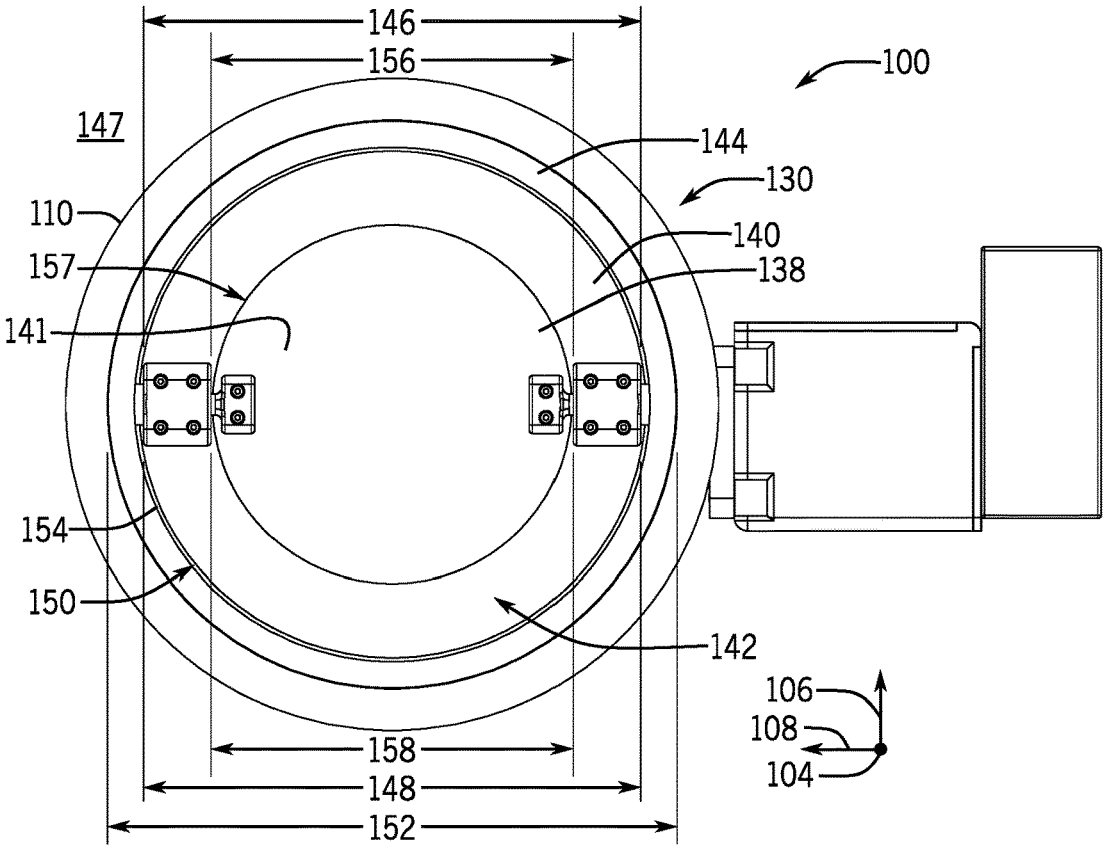
FIG. 3 is a front elevation view of an embodiment of the flow modulation device of FIG. 2, in accordance with an aspect of the present disclosure.

FIG. 3 illustrates a front elevation view of the split-blade damper 100, in which the inner blade 138 and the outer blade 140 are disposed in the fully closed position 142. As shown in the illustrated embodiment, the inner and outer blades 138, 140 are oriented in opposition to the airflow through the flow path 141 in the fully closed position 142, such that the inner and outer blades 138, 140 bisect the flow path 141. In some embodiments, an insulator 144, or an annular insulator, may be disposed within and extend along a length of the housing 110, such that the insulator 144 circumferentially surrounds the damper assembly 130. The insulator 144 may include foam, cork, aluminum foil, or any other suitable insulating material. As such, the insulator 144 may mitigate heat transfer between the air within the split-blade damper 100 and an ambient environment 147 that surrounds the split-blade damper 100.

In some embodiments, an outer diameter 146, or an outside dimension, of the outer blade 140 may be approximately equal to an inner diameter 148 of the insulator 144. Accordingly, a first gap 150 formed between the outer blade 140 and the insulator 144 may include a width that is substantially zero when the outer blade 140 is in the fully closed position 142. For example, in certain embodiments, the width of the first gap 150 may be between 0.5 millimeters (mm) and 1.5 mm, or less than 0.5 mm when the outer blade 140 is in the fully closed position 142. As such, the outer blade 140 may reduce, or substantially eliminate, airflow between the outer blade 140 and the insulator 144 when the outer blade 140 is in the fully closed position 142.

In certain embodiments, the outer blade 140 may be configured to physically contact the insulator 144 when the outer blade 140 is in the fully closed position 142, and thus, generate a fluidic seal between the outer blade 140 and the insulator 144. In such embodiments, the outer diameter 146 of the outer blade 140 is, for example, 0.5 mm, 1 mm, 1.5 mm, or more, greater than the inner diameter 148 of the insulator 144. Accordingly, the insulator 144 may include a resilient, or otherwise pliable, material, such as foam or cork, which enables a perimeter of the outer blade 140 to compress the insulator 144 when the outer blade 140 is in the fully closed position 142. As such, physical contact between the outer blade 140 and the insulator 144 may facilitate blocking airflow between the outer blade 140 and the insulator 144.

It should be noted that in certain embodiments, the insulator 144 may be omitted from the split-blade damper 100. In such embodiments, the outer diameter 146 of the outer blade 140 is sized to be approximately equal to, or marginally less than, an inner diameter 152 of the housing 110, rather than the inner diameter 148 of the insulator 144. Accordingly, in such embodiments, the outer blade 140 may substantially block airflow between a gap that extends between the outer blade 140 and the housing 110. In some embodiments, a seal 154 may be disposed about a perimeter of the outer blade 140, which is configured to engage with the insulator 144 or the housing 110 when the outer blade 140 is in the fully closed position 142. In such embodiments, the seal 154 additionally facilitates blocking airflow between outer blade 140 and the insulator 144 or between the outer blade 140 and the housing 110 when the outer blade 140 is in the fully closed position 142.

Similarly, an inner diameter 156, or an inside dimension of the outer blade 140 is approximately equal to an outer diameter 158, or an outside dimension of the inner blade 138. Accordingly, a second gap 157 extending between the inner blade 138 and the outer blade 140 may include a width that is substantially zero when the inner blade 138 and the outer blade 140 are each in the fully closed position 142. As such, the damper assembly 130 blocks substantially all airflow through the flow path 141 of the split-blade damper 100 when the inner and outer blades 138, 140 are in the fully closed position 142.

In some embodiments, a cross-sectional area of the inner blade 138 is substantially equal to a cross-sectional area of the outer blade 140. In other words, the cross-sectional area of the inner blade 138 and the cross-sectional area of the outer blade 140 are each approximately fifty percent of the cross-sectional area of the damper assembly 130, and thus, approximately fifty percent of the total cross-sectional area of the flow path 141. However, it should be noted that in other embodiments the cross-sectional area of the inner and outer blades 138, 140 may be different from one another. For example, a cross-sectional area of the inner blade 138 can include approximately seventy five percent of the total cross-sectional area of the damper assembly 130, while a cross-sectional area of the outer blade 140 includes approximately twenty five percent of the total cross-sectional area of the damper assembly 130. In still further embodiments, a cross-sectional area of each of the inner and outer blades 138, 140 may include any suitable percentage of the total cross-sectional area of the damper assembly 100.

Figure 4:
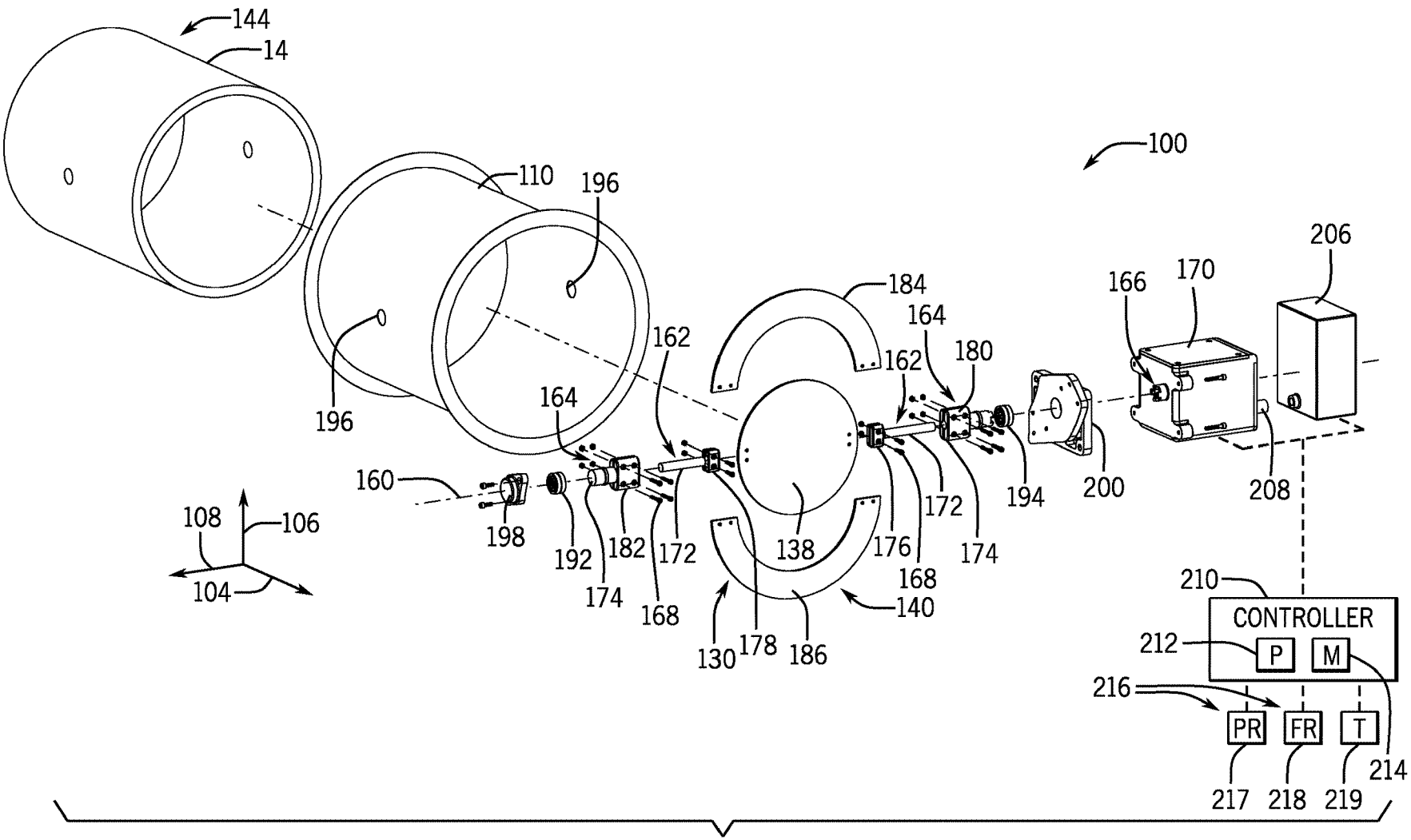
FIG. 4 is an exploded view of an embodiment of the flow modulation device of FIG. 2, in accordance with an aspect of the present disclosure.

FIG. 4 is an exploded view of an embodiment of the split-blade damper 100. In some embodiments, the inner blade 138 and the outer blade 140 are coupled to inner blade holders 162 and outer blade holders 164, respectively, which may collectively form the shaft 145. For instance, the inner blade holders 162 may form a first shaft and the outer blade holders 164 may form a second shaft, where the first and second shafts are collectively referred to as the shaft 145. As such, the inner blade holders 162 and the outer blade holders 164 are configured to rotate about a centerline 160 extending through diametrically opposite sides or sections of the housing 110. As described in greater detail herein, the inner blade holders 162 are disposed concentrically within the outer blade holders 164, and thus, enable both the inner and outer blade holders 162, 164 to be oriented collinear to the centerline 160. The inner blade holders 162 and the outer blade holders 164 couple to a pair of couplings 166 extending from a driving unit 170 of the split-blade damper 100. The driving unit 170 can control individually rotation of each coupling of the pair of couplings 166, and thus, enable the driving unit 170 to individually modulate a position of each of the inner and outer blades 138, 140.

For example, the inner blade 138 may be coupled to the inner blade holders 162 via fasteners 168, such as bolts, springs pins, adhesives, or the like. Each of the inner blade holders 162 includes a shaft 172 that is configured to extend through a respective opening 174 disposed within each of the outer blade holders 164. Accordingly, the openings 174 enable the inner blade holders 162 to rotate independent of the outer blade holders 164, while substantially restricting motion of the inner blade holders 162 with respect to the housing 110. The inner blade holders 162 include an active inner blade holder 176 that is coupled a respective coupling of the pair of couplings 166 via the shaft 172 and a passive inner blade holder 178 that is disposed opposite the active inner blade holder 176. Accordingly, the driving unit 170 may rotate the active inner blade holder 176, and thus, rotate the inner blade 138 of the damper assembly 130.

Similar to the active inner blade holder 176 and the passive inner blade holder 178 discussed above, the outer blade 140 couples to an active outer blade holder 180 and a passive outer blade holder 182 of the outer blade holders 164. The active outer blade holder 180 is configured to couple to the other coupling of the pair of couplings 166, such that the driving unit 170 can individually control rotation of the active outer blade holder 180, and thus, the outer blade 140. In some embodiments, the outer blade 140 may be divided into a first portion 184, or a first flat surface, and a second portion 186, or a second flat surface, that are coupled together to form the outer blade 140. In certain embodiments, the first and second portions 184, 186 may be geometrically similar, and thus, interchangeable with one another. Alternatively, the outer blade 140 may be a single-piece component. Fasteners, such as the fasteners 168, may be used to couple the outer blade 140 to the outer blade holders 164. However, in other embodiments, the outer blade 140 may be coupled to the outer blade holders 164 using any other suitable technique, such as welding, bonding glue, or the like.

The outer blade holders 164 may be rotatably coupled to a first bearing 192 and a second bearing 194, which are configured to support the passive outer blade holder 182 and the active outer blade holder 180, respectively. The bearings 192, 194 are disposed within apertures 196 disposed on diametrically opposite sections of the housing 110. In some embodiments, a bearing cap 198 may be disposed about the first bearing 192 and coupled to the housing 110, such that the bearing cap 198 blocks movement of the first bearing 192 along the lateral direction 108. Similarly, a bracket 200 may be disposed about the second bearing 194 and coupled to an opposite side of the housing 110, and thus, block movement of the second bearing 194 along the lateral direction 108. Accordingly, the bearings 192, 194 enable the outer blade holders 164 to rotate about the centerline 160, while substantially restricting movement of the outer blade holders 164 in the longitudinal, vertical, and lateral directions 104, 106, and 108.

In some embodiments, the driving unit 170 couples to the bracket 200 which, thus, enables the driving unit 170 to couple to the split-blade damper 100. The driving unit 170 includes an actuator 206, which supplies power to the driving unit 170 through an input shaft 208. The power supplied by the actuator 206 enables the driving unit 170 to control rotation of each coupling of the pair of couplings 166. The driving unit 170 and/or the actuator 206 may be communicatively coupled to a controller 210 of the split-blade damper 100, which may be used to control operation of the driving unit 170 and/or the actuator 206. In some embodiments, the controller 210 may be used in addition to, or in lieu of, the control panel 82. For example, one or more control transfer devices, such as wires, cables, wireless communication devices, and the like, may communicatively couple the driving unit 170, the actuator 206, or any other suitable components of the split-blade damper 100 to the controller 210. The controller 210 includes a processor 212, such as a microprocessor, which may execute software for controlling the components of the split-blade damper 100, such as the driving unit 170 and/or the actuator 206. Moreover, the processor 212 may include multiple microprocessors, one or more "general-purpose" microprocessors, one or more special-purpose microprocessors, and/or one or more application specific integrated circuits (ASICS), or some combination thereof.

For example, the processor 212 may include one or more reduced instruction set (RISC) processors. The controller 210 also includes a memory device 214 that stores information such as control software, look up tables, configuration data, etc. The memory device 214 may include a volatile memory, such as random access memory (RAM), and/or a nonvolatile memory, such as read-only memory (ROM). The memory device 214 may store a variety of information and may be used for various purposes. For example, the memory device 214 may store processor-executable instructions including firmware or software for the processor 212 execute, such as instructions for controlling the components of the split-blade damper 100. In some embodiments, the memory device 214 is a tangible, non-transitory, machine-readable-medium that may store machine-readable instructions for the processor 212 to execute. The memory device 214 may include ROM, flash memory, a hard drive, or any other suitable optical, magnetic, or solid-state storage medium, or a combination thereof. The memory device 214 may store data, instructions, and any other suitable data.

In some embodiments, the controller 210 receives feedback from sensors 216 disposed within the split-blade damper 100 and/or the ductwork 14 and the control device 16. For example, the sensors 216 may include, but are not limited to, pressure sensors 217, such one or more as Pitot-static tubes, flow rate sensors 218, such as one or more mass airflow sensors (MAF), and/or temperature sensors 219, such as one or more thermocouples. Additionally, or otherwise, the sensors 216 may include any other suitable instruments that directly or indirectly measure operational parameters associated with the split-blade damper 100 and/or the HVAC system coupled thereto. As described in greater detail herein, the controller 210 may instruct the driving unit 170 to modulate a position of the inner blade 138 and/or a position of the outer blade 140 in response to feedback acquired by the sensors 216. It should be noted that in certain embodiments, the sensors 216 may be included integrally within the control device 16. Accordingly, the controller 210 modulate the position of the inner blade and/or the position of the outer blade 140 in response to feedback acquired by the control device 16.

Figure 5:
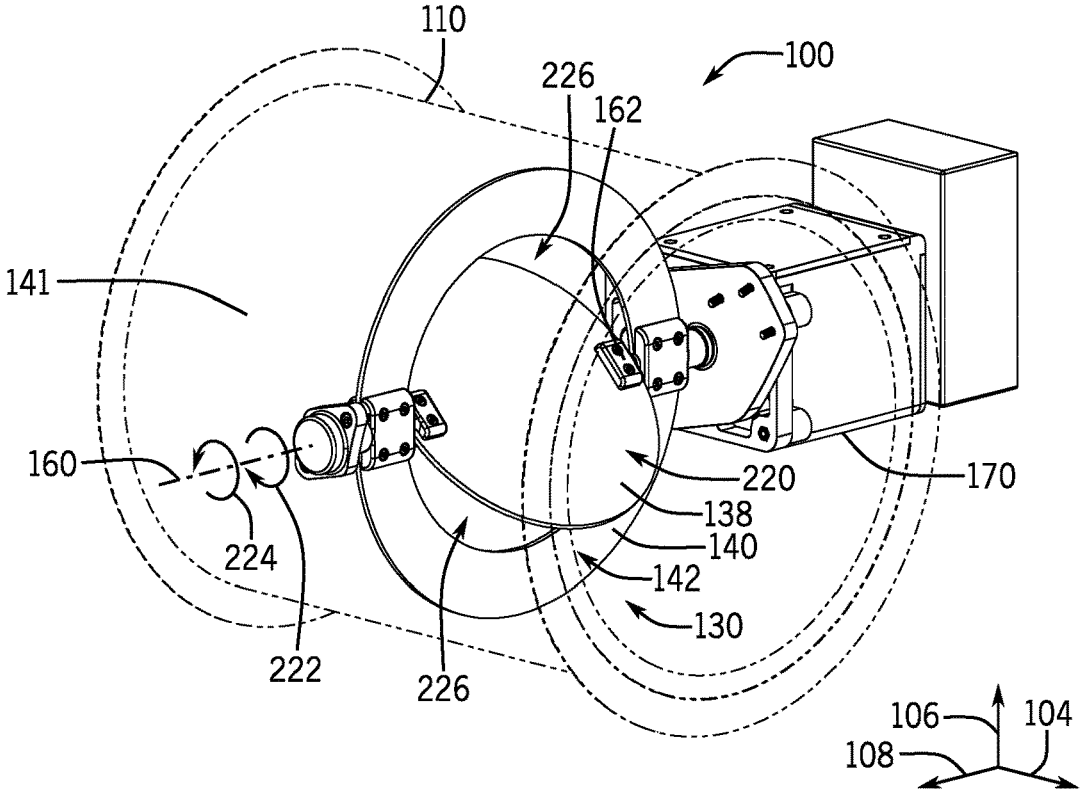
FIG. 5 is a perspective view of an embodiment of the flow modulation device of FIG. 2, in accordance with an aspect of the present disclosure.

FIG. 5 illustrates an embodiment of the split-blade damper 100 in which the inner blade 138 is disposed in a partially open position 220, while the outer blade 140 is disposed in the fully closed position 142. As discussed above, the driving unit 170 may rotate the active inner blade holder 176 about the centerline 160, and thus, enable the inner blade 138 to rotate toward the partially open position 220. It should be noted that the driving unit 170 may rotate the inner blade 138 about the centerline 160 in a clockwise direction 222 or, conversely, in a counter-clockwise direction 224. Passages 226 are generated between the inner and outer blades 138, 140 when the inner blade 138 transitions from the fully closed position 142 to the partially open position 220. As such, rotation of the inner blade 138 adjusts a cross-sectional area of the passages 226 or, in other words, the effective cross-sectional area of the flow path 141 through the housing 110. For example, in the illustrative embodiment of FIG. 5, rotating the inner blade 138 about the centerline 160 in the clockwise direction 222 initially decreases a cross-sectional area of the passages 226, and thus, initially decreases an effective cross-sectional area of the flow path 141. Conversely, rotating the inner blade about the centerline 160 in the counter-clockwise direction 224 initially increases the cross-sectional area of the passages 226, and thus, initially increases the effective cross-sectional area of the flow path 141.

Figure 6:
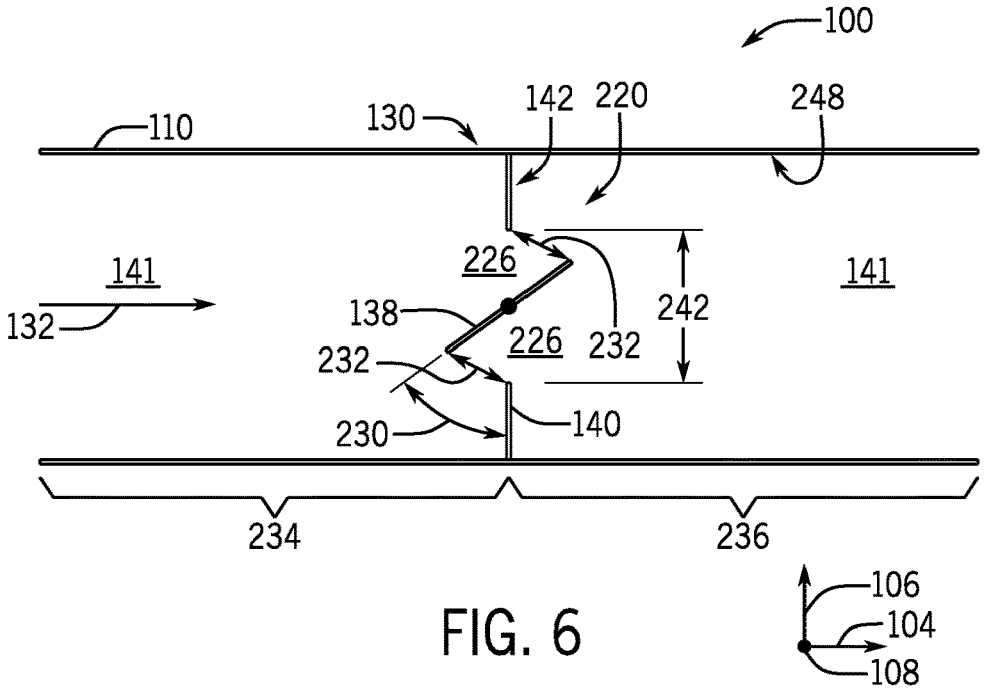
FIG. 6 is a cross-sectional schematic view of an embodiment of the flow modulation device of FIG. 2, in accordance with an aspect of the present disclosure.

FIG. 6 is a cross-sectional schematic view of an embodiment of the split-blade damper 100 in which the outer blade 140 is in the fully closed position 142 and the inner blade is in the partially open position 220, such as shown in the illustrative embodiment of FIG. 5. As discussed above, a stroke angle of conventional dampers using a single damper blade is relatively small, because the single damper blade is used to individually adjust airflow through a housing of the conventional damper. However, because a cross-sectional area of the inner blade 138 includes a cross-sectional area that is, for example, half of the cross-sectional area of the housing 110, a stroke angle 230 of the inner blade 138 may be substantially increased compared to the stroke angle of conventional dampers. For example, rotating the inner blade 138 by a relatively large stroke angle 230 generates a cross-sectional area of the passages 226 that is substantially equal to a cross-sectional area of passages that may be generated by a conventional damper blade by a second, smaller stoke angle. In other words, because a cross-sectional area of the inner blade 138 is less than a cross-sectional area of the entire damper assembly 130, which includes the inner blade 138 and the outer blade 140, the stroke angle 230 of the inner blade 138 generates an effective cross-sectional area of the flow path 141 that is equal to an effective cross-sectional area of the flow path 141 generated by rotating the entire damper assembly 130 by an angle that is less than the stroke angle 230. Accordingly, a magnitude of a stroke angle of the inner blade 138 is increased during operation of the split-blade damper 100, which enables more precise control over the cross-sectional area of the flow path 141.

Rotating the inner blade 138 by a relatively large angle of rotation, such as the stroke angle 230, may enable a width 232 of the passages 226 on either side of the inner blade 138 to be relatively large, and thus, mitigate frictional effects generated while the air flows through the passages 226. In other words, increasing a dimension of the width 232 may decrease frictional effects between the air 132 and the inner and outer blades 138, 140. Accordingly, the split-blade damper 100 may facilitate airflow through the passages 226, and thus, reduce a pressure differential that may be generated between an upstream section 234 of the housing 110 and a downstream section 236 of the housing 110.

In some embodiments, increasing the width 232 of the passages 226 may additionally reduce turbulence that may be generated while the air flows across the damper assembly 130. The reduction of such turbulent airflow reduces audible noise that may be generated through velocity fluctuations and/or pressure fluctuations of the air. As will be appreciated, modulating airflow using the inner blade 138, while maintaining the outer blade 140 in the fully closed position 142, may centralize airflow discharging from the passages 226 within the damper assembly 130 near an inner region 242 of the flow path 141. As such, shear forces generated due to frictional effects between the air and an inner surface 248 of the housing 110 may be reduced, thereby guiding the air across the downstream section 236 of the split-blade damper 100 at a substantially uniform velocity. Accordingly, the damper assembly 130 may mitigate turbulent airflow generated due to velocity fluctuations of the air 132, and thus, reduce noise that may be generated while the air flows through the split-blade damper 100.

Figure 7:
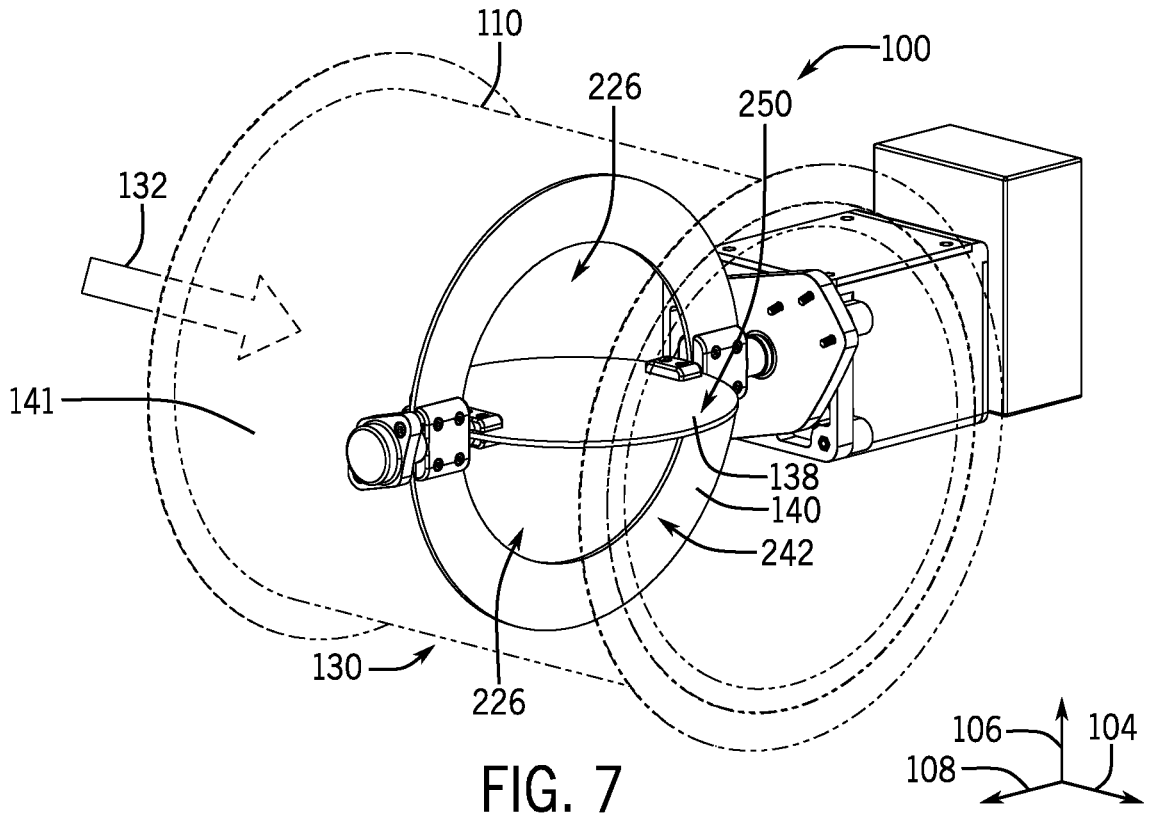
FIG. 7 is a perspective view of an embodiment of the flow modulation device of FIG. 2, in accordance with an aspect of the present disclosure.

FIG. 7 is a perspective view of an embodiment of the split-blade damper 100, in which the inner blade 138 is disposed in a fully open position 250 and the outer blade 140 is disposed in the fully closed position 142. In some embodiments, the fully open position 250 of the inner blade 238 is indicative of the inner blade 138 being oriented substantially perpendicular to the outer blade 140 or, in the illustrative embodiment, being oriented substantially parallel to the longitudinal axis 104. In other words, the inner blade 138 is oriented parallel to the airflow through the flow path 141 in the fully open position 250. As such, the cross-sectional area of the passages 226, and thus, the effective cross-sectional area of the flow path 141, may be substantially equal to half of the total cross-sectional area of the flow path 141.

Accordingly, the air may flow through the split-blade damper 100 at a flow rate that may be approximately equal to half of a first threshold flow rate of the split-blade damper 100.

Figure 8:
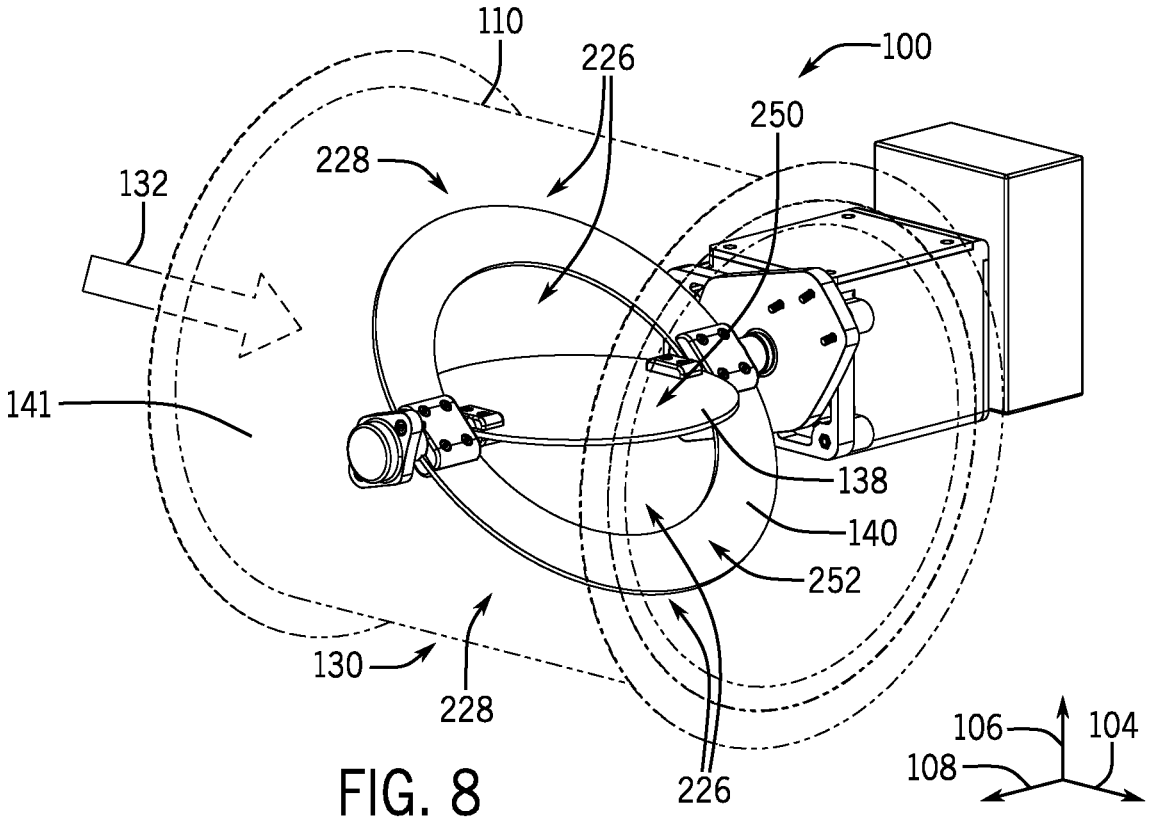
FIG. 8 is a perspective view of an embodiment of the flow modulation device of FIG. 2, in accordance with an aspect of the present disclosure.

The split-blade damper 100 may increase the flow rate above the first threshold flow rate by transitioning the outer blade 140 to a partially open position 252, as shown in FIG. 8. As such, a cross-sectional area of the passages 226 additionally include a cross-sectional area of gaps 228 that may be generated between the housing 110 and the outer blade 140. Accordingly, a cross-sectional area of the passages 226, and thus, an effective cross-sectional area of the flow path 141, is increased. The partially open position 252 of the outer blade 140 may include any position between the fully closed position 142 of the outer blade 140 and a fully open position 254 of the outer blade 140, as shown in FIG. 9.

The fully open position 254 is indicative of the outer blade 140 being oriented substantially parallel to the inner blade 138 when the inner blade 138 is also in the fully open position 250. In other words, the outer blade 140 is oriented parallel to the airflow through the flow path 141 in the fully open position 254. When the inner blade 138 and the outer blade 140 are in respective fully open positions 250, 254, a cross-sectional area of the passages 226, and thus the effective cross-sectional area of the flow path 141, may be substantially equal to a total cross-sectional area of the flow path 141. As such, the damper assembly 130 may enable substantially all of the air 132 to flow through the split-blade damper 100 unrestricted, and thus, enable a second threshold flow rate of air to flow through the split-blade damper 100.

Figure 10:
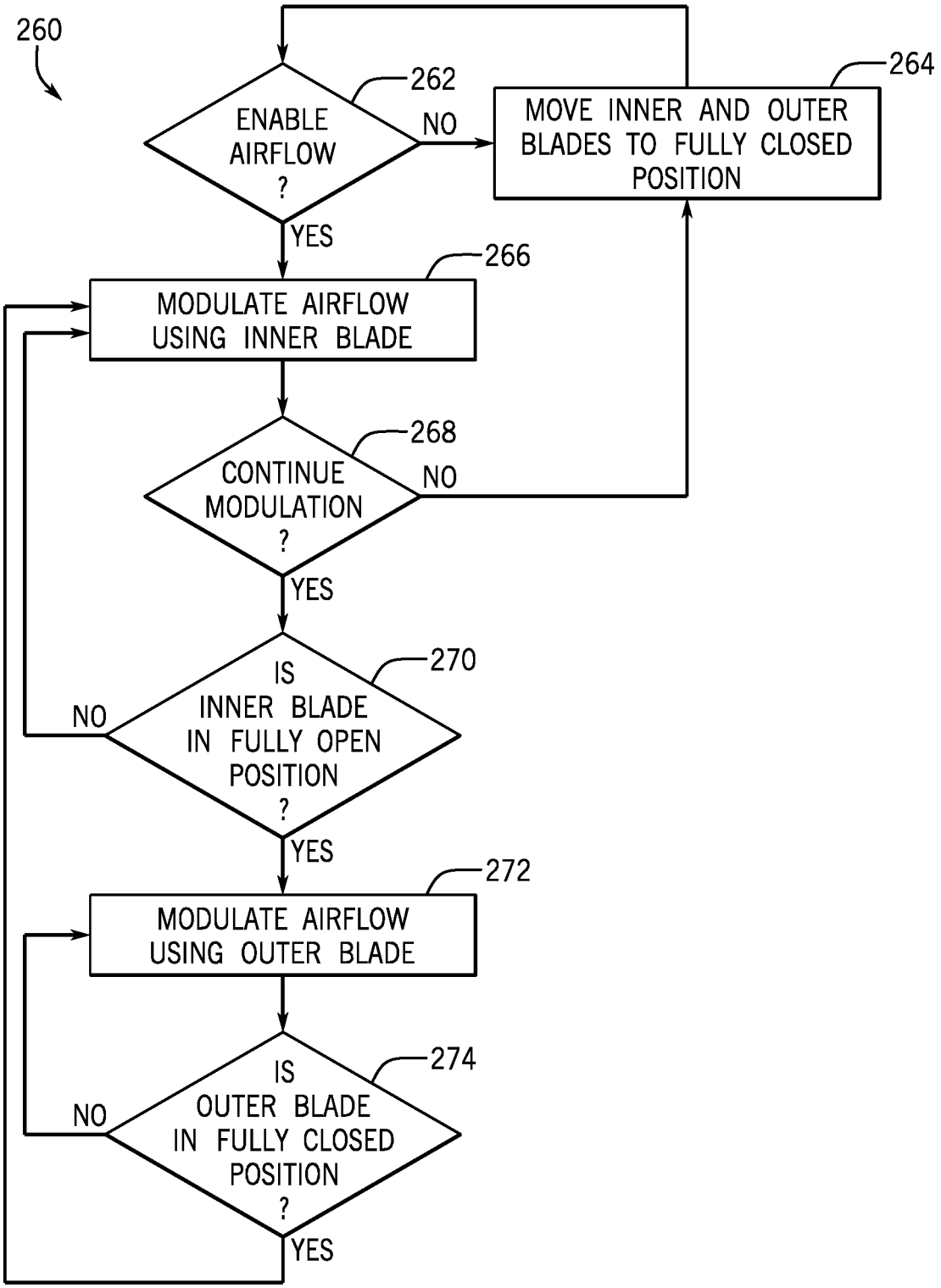
FIG. 10 is a block diagram of an embodiment of a process for operating the flow modulation device of FIG. 2, in accordance with an aspect of the present disclosure.

FIG. 10 is a block diagram of an embodiment of a process 260 for operating the split-blade damper 100. The process 260 includes determining whether to enable airflow through the split-blade damper 100, as indicated by block 262. For example, the controller 210 may receive operating instructions that are indicative of a target flow rate of the air through the split-blade damper 100. The controller 210 may receive the operating instruction through input from an operator, from the sensors 216 disposed near the split-blade damper 100, sensors of a vapor compression system associated with the HVAC unit 12 that detect operating conditions of the vapor compression system, the control device 16, or any other suitable input source. If the operating instruction indicate that a value of the target flow rate is substantially zero, the controller 210 may instruct the driving unit 170 to move the inner blade 138 and the outer blade 140 to the fully closed position 142, as indicated by block 264. As such, an effective cross-sectional area of the flow path 141 is substantially zero, such that the damper assembly 130 may block substantially all airflow through the split-blade damper 100. Conversely, if a value of the target flow rate is nonzero or, in other words, if the operating instructions indicate that airflow through the split-blade damper 100 is desired, the controller 210 may instruct the driving unit 170 to move the inner blade 138 to the partially open position 252. In such cases, the controller 210 may instruct the driving unit 170 to maintain a position of the outer blade 140 in the fully closed position 142. As such, the controller 210 may adjust a flow rate of fluid through the split-blade damper 100 using the inner blade 138, as indicated by block 266.

In some embodiments, the controller 210 may measure an actual flow rate of the air using the flow rate sensors 218, or any other suitable flow measuring instruments disposed within the split-blade damper 100 and/or the ductwork 14. It should be noted that the flow rate sensors 218 may include any measuring instruments that are suitable to directly or indirectly observe parameters related to the flow rate of the air through the split-blade damper 100. The controller 210 may compare the actual flow rate to the target flow rate and adjust a stroke angle of the inner blade 138 when a difference between the actual flow rate and the target flow rate exceeds a threshold amount. For example, if the actual flow rate of the air 132 is below the target flow rate by the threshold amount, the controller 210 may instruct the driving unit 170 to increase a stroke angle of the inner blade 138, and thus, increase an effective cross-sectional area of the flow path 141. Accordingly, a flow rate of the air through the split-blade damper 100 may increase. Conversely, when the actual flow rate of fluid within the split-blade damper 100 is below the target value by the threshold amount, the controller 210 may instruct the driving unit 170 to decrease a stroke angle of the inner blade 138, and thus, decrease an effective cross-sectional area of the flow path 141.

Further, the controller 210 may monitor the received operating instructions and determine whether continued modulation of the airflow is desired, as indicated by block 268. For example, if the operating instructions indicate that a desired value of the target flow rate is substantially zero or, in other words, indicate that a flow rate of air through the split-blade damper 100 should be blocked, the controller 210 may instruct the driving unit 170 to move the inner blade 138 to the fully closed position, as indicated by block 264. Otherwise, the controller 210 will continue to adjust the stroke angle of the inner blade 138, such that a deviation between the actual flow rate and the target flow rate is reduced. In some embodiments, a value of the target flow rate may exceed a first threshold flow rate that is indicative of the inner blade 138 being disposed in the fully open position 250. When the controller 210 determines that a position of the inner blade 138 reaches the fully open position 250, as indicated by block 270, and the actual flow rate through the split-blade damper 100 is still less than the target flow rate, the controller 210 can instruct the driving unit 170 to move the outer blade 140 to the partially open position 250. Accordingly, the controller 210 may modulate the flow rate of the air that is within a second threshold range using the outer blade 140, as indicated by block 272. The inner blade 138 remains in the fully open position 250 while the controller 210 modulates a position of the outer blade 140. Conversely, if the inner blade 138 does not reach the fully open position 250, the controller 210 continues adjusting airflow through the split-blade damper 100 using the inner blade 138, as indicated by block 266.

Similar to the stroke angle of the inner blade 138, the controller 210 may continuously adjust a stroke angle of the outer blade 140 based on feedback received from the sensors 216, such as the flow rate sensors 220. For example, if an actual flow rate of the fluid through the split-blade damper 100 is below the target flow rate by a threshold amount, the controller 210 may increase the stroke angle of the outer blade 140, such that an effective cross-sectional area of the flow path 141 is increased. Conversely, the controller 210 may decrease a stroke angle of the outer blade 140 if the actual flow rate of the air 132 is above the target flow rate by a predetermined amount. It should be noted that a maximum flow rate of air through the split-blade damper 100 may be achieved when both the outer blade 140 is moved to the fully open position 254.

In the illustrative embodiment of the process 260, the controller 210 monitors a position of the outer blade 140 and determines if the outer blade 140 moves to the fully closed position 142 during adjustment of the airflow through the split-blade damper 100, as indicated by block 274. For example, if the operating instructions indicate a decrease in the target flow rate below the second threshold flow rate, the outer blade 140 moves to the fully closed position 142, and the controller 210 may return to adjusting airflow through the split-blade damper using the inner blade 138, as indicated by block 266. As discussed above, the outer blade 140 remains in the fully closed position 142 when the controller 210 modulates airflow using the inner blade 138. If the operating instructions indicate a target flow rate of substantially zero, the controller 210 may stop modulation of the airflow and move the inner blade 138 to the fully closed position 142, as indicated by block 268 and block 264, respectively. The controller 210 continues to maintain both the inner and outer blades 138, 140 in the fully closed position until the operating instructions indicate that the target flow rate is above zero. If a value of the target flow rate is within the second threshold flow rate, the controller 210 may continue to modulate the flow of the air through the damper using the outer blade 140.

As discussed above, the aforementioned embodiments of the split-blade damper 100 may be used on the HVAC unit 12, a residential heating and cooling system, or in any other suitable HVAC system. Additionally, the specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A damper for controlling an air flow, comprising:

a housing defining a passageway configured to receive the air flow;

a ring comprising a first flat surface extending between an outside dimension of the ring and an inside dimension of the ring, wherein the outside dimension is configured to fit within the passageway;

a first outer holder coupled to the first flat surface and pivotably coupled to the housing to enable the ring to pivot about an axis bisecting the passageway;

a second outer holder coupled to the first flat surface and pivotably coupled to the housing;

a disc comprising a second flat surface extending across a diameter of the disc;

a first inner holder coupled to the second flat surface and pivotably coupled to the first outer holder to position the disc within the inside dimension of the ring and enable the disc to pivot about the axis;

a second inner holder coupled to the second flat surface and pivotably coupled to the second outer holder; and an actuator coupled to the first outer holder and the first inner holder and configured to actuate the first outer holder and the first inner holder to separately pivot the ring and the disc about the axis.

2. The damper of claim 1, wherein the first outer holder comprises a first shaft coupled to the actuator and a channel extending through the first outer holder, wherein the first inner holder comprises a second shaft extending through the channel and separately coupled to the actuator.

3. The damper of claim 2, comprising a bearing disposed within an aperture of the housing and supporting the first shaft to pivotably couple the first shaft to the housing.

4. The damper of claim 1, wherein the ring is pivotable about the axis between a closed position such that the first flat surface of the ring is oriented against the air flow and an open position such that the first flat surface of the ring is oriented with the air flow, wherein the disc is separately rotatable about the axis between a closed position such that the second flat surface of the disc is oriented against the air flow and an open position such that the second flat surface of the disc is oriented with the air flow.

5. The damper of claim 1, comprising a controller communicatively coupled to the actuator and configured to receive feedback indicative of an operating parameter, wherein the controller is configured to control the actuator to adjust respective positions of the ring and the disc based on the feedback.

6. The damper of claim 1, wherein the ring comprises a first portion and a second portion that collectively define the first flat surface, wherein the first portion is separate from the second portion, and wherein the first outer holder couples the first portion to the second portion.

7. The damper of claim 6, wherein the first portion is geometrically similar to the second portion.

8. The damper of claim 1, wherein the first inner holder is separate from the second inner holder and is spaced apart from the second inner holder along the axis such that the second flat surface extends continuously between the first inner holder and the second inner holder.

9. A damper for controlling an air flow, comprising:

a housing defining a passageway configured to receive the air flow;

an inner blade comprising a flat surface extending across a diameter of the inner blade;

an outer blade comprising an additional flat surface extending between an outside dimension of the outer blade and an inside dimension of the outer blade, wherein the outer blade and the inner blade are in a concentric arrangement and pivotable about an axis, wherein the diameter of the inner blade fits within the inside dimension of the outer blade and the outside dimension of the outer blade fits within the passageway;

a first outer holder coupled to the additional flat surface and pivotably coupled to the housing to enable the outer blade to pivot about the axis;

a second outer holder coupled to the additional flat surface and pivotably coupled to the housing;

a first inner holder coupled to the flat surface and pivotably coupled to the first outer holder to enable the inner blade to pivot about the axis;

a second inner holder coupled to the flat surface and pivotably coupled to the second outer holder;

an actuator coupled to the first outer holder and the first inner holder and configured to actuate the first outer holder and the first inner holder to separately adjust the inner blade and the outer blade between respective open positions and respective closed positions relative to the passageway; and a controller configured to receive feedback indicative of an operational parameter and control the actuator to adjust respective positions of the inner blade and the outer blade based on the feedback.

10. The damper of claim 9, wherein the controller is configured to adjust a respective position of the inner blade, the outer blade, or both, based on the feedback to achieve a target flow rate of the air flow through the housing.

11. The damper of claim 10, wherein the controller is configured to:

receive the feedback from a sensor, wherein the feedback is indicative of a flow rate of the air flow through the housing;

compare the flow rate to the target flow rate; and instruct the actuator to adjust the respective position of the inner blade, the outer blade, or both to reduce a difference between the flow rate and the target flow rate.

12. The damper of claim 11, wherein the controller is configured to adjust the respective position of the outer blade in response to a determination that the difference between the flow rate and the target flow rate exceeds a threshold value and the inner blade is disposed in a fully open position.

13. The damper of claim 9, wherein the controller is configured to adjust a flow rate of the air flow through the passageway by instructing the actuator to modulate the inner blade between a respective fully closed position and a respective fully open position while retaining the outer blade in a respective fully closed position.

14. The damper of claim 13, wherein the controller is configured to instruct the actuator to adjust a respective position of the outer blade from the respective fully closed position to a respective partially open position upon a determination that the inner damper is in the respective fully open position and the flow rate of the air flow is below a target value.

15. The damper of claim 9, wherein the controller is communicatively coupled to a thermostat and is configured to adjust the respective positions of the inner blade and the outer blade based on feedback from the thermostat.

16. A damper for controlling an air flow, comprising:

a housing defining a passageway configured to receive the air flow;

a first blade comprising a first flat surface and configured pivot about an axis to transition between a first open position and a first closed position in the passageway, wherein the first blade bisects the passageway in the first closed position such that the first flat surface is oriented crosswise to a direction of the air flow through the housing;

a second blade disposed within an opening of the first blade and comprising a second flat surface, wherein the second blade is configured to pivot about the axis to transition between a second open position and a second closed position in the passageway, wherein the second blade bisects the passageway in the second closed position such that the second flat surface is oriented crosswise to the direction of the air flow through the housing;

a first outer holder coupled to the first flat surface and pivotably coupled to the housing to enable the first blade to pivot about the axis;

a first inner holder coupled to the second flat surface and pivotably coupled to the first outer holder to position the second blade within the opening and enable the second blade to pivot about the axis;

a second outer holder coupled to the first flat surface and pivotably coupled to the housing;

a second inner holder coupled to the second flat surface and pivotably coupled to the second outer holder; and a controller communicatively coupled to an actuator configured to separately open and close the first blade and the second blade.

17. The damper of claim 16, wherein the controller is configured to receive feedback indicative of an operational parameter and control the actuator to adjust respective positions of the first blade and the second blade based on the feedback.

18. The damper of claim 17, wherein the controller is configured to adjust a respective position of the first blade, the second blade, or both based on the feedback to achieve a target flow rate of the air flow through the housing.

19. The damper of claim 18, wherein the controller is configured to:

receive the feedback from a sensor, wherein the feedback is indicative of a flow rate of the air flow through the housing;

compare the flow rate to the target flow rate; and instruct the actuator to adjust the respective position of the first blade, the second blade, or both to reduce a difference between the flow rate and the target flow rate.

20. The damper of claim 19, wherein the controller is configured to:

determine whether the second blade is disposed in a fully open position;

determine whether the flow rate is below the target flow rate; and upon a determination that that the second blade is disposed in the fully open position and the flow rate is below the target flow rate, instruct the actuator to adjust the respective position of the first blade while retaining the second blade in the fully open position.

21. The damper of claim 20, wherein the controller is communicatively coupled to a thermostat, and wherein the controller is configured to adjust respective positions of the first blade and the second blade based on feedback from the thermostat.

* * * * *